US008319202B2

(12) United States Patent
Viturro et al.

(10) Patent No.: US 8,319,202 B2
(45) Date of Patent: Nov. 27, 2012

(54) COLOR REGISTRATION STRATEGY FOR PREPRINTED FORMS

(75) Inventors: R. Enrique Viturro, Rochester, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 371 days.

(21) Appl. No.: 12/755,117

(22) Filed: Apr. 6, 2010

(65) Prior Publication Data

US 2011/0243581 A1 Oct. 6, 2011

(51) Int. Cl.
*G03G 15/00* (2006.01)
*B41J 29/393* (2006.01)

(52) U.S. Cl. ..... 250/548; 250/559.44; 250/557; 399/15; 399/31; 347/19

(58) Field of Classification Search ..... 250/548, 250/559.01, 559.05, 559.44, 557; 399/9, 399/15, 31, 51, 301; 347/5, 19, 41
See application file for complete search history.

(56) References Cited

U.S. PATENT DOCUMENTS 7,630,519 B2 12/2009 Nagarajan
2008/0062219 A1 3/2008 Mizes et al.
2008/0124158 A1 5/2008 Folkins et al.
2009/0265950 A1 10/2009 Mizes et al.
2012/0056928 A1* 3/2012 Powers et al. ..... 347/19
2012/0155894 A1* 6/2012 Kim et al. ..... 399/31

* cited by examiner

*Primary Examiner* — Kevin Pyo
(74) *Attorney, Agent, or Firm* — Pillsbury Winthrop Shaw Pittman, LLP

(57) ABSTRACT

A computer-implemented method for performing color registration on template media having template markings thereon. The method comprising sensing the template media using a linear array sensor to obtain first image data; printing a test pattern on the template media; sensing the template media along with the test pattern printed thereon to obtain second image data; transforming the first image data and the second image data into an absorbance space to obtain a first absorbance and a second absorbance, respectively; calculating a difference between the first and the second absorbances to obtain an output absorbance; transforming the output absorbance into a reflectivity space to obtain an output data; determining a process direction misregistration and a cross-process direction misregistration from the output data; and adjusting a cross-process position and a process position of print heads based on the process and cross-process direction misregistration to provide accurate color registration on subsequent template media.

35 Claims, 12 Drawing Sheets

NOTE: QUALITY OF IMAGE IS LOW (ACTUAL IMAGE)

NOTE: QUALITY OF IMAGE IS LOW (ACTUAL IMAGE)

NOTE: QUALITY OF IMAGE IS LOW (ACTUAL IMAGE)

NOTE: QUALITY OF IMAGE IS LOW (ACTUAL IMAGE)

NOTE: QUALITY OF IMAGE IS LOW (ACTUAL IMAGE)

NOTE: QUALITY OF IMAGE IS LOW (ACTUAL IMAGE)

COLOR REGISTRATION STRATEGY FOR PREPRINTED FORMS

BACKGROUND

1. Field

The present disclosure relates to a method and a system for performing color registration on template media having template markings thereon.

2. Description of Related Art

In a continuous feed direct marking printer (i.e., based on solid inkjet technology), multiple print heads are distributed over a long print zone to obtain the desired color and image resolutions. Integrated Registration and Color Control (IRCC) technology is configured to achieve color to color registration using a closed feedback loop controller. At cycle up of the continuous feed direct marking printer, the closed feedback loop controller is configured to print a registration control target (i.e., test pattern), capture the registration control target using the Image On Web Array (IOWA) sensor, analyze the IOWA sensor response profile, and determine the x-position and y-position of each print head. The computed registration errors are corrected by y-registration actuators and x-registration actuators. This IRCC technology has been demonstrated in the continuous feed direct marking printer for a blank paper.

The transaction printing industry uses pre-printed forms. For example, these pre-printed forms are used as medical claim forms, shipping documents, purchase orders, insurance records, etc. These pre-printed forms are used, for example, to add color, logos, etc. to a large market mainly populated by monochrome (i.e., one color or shades of one color) web printers.

The pre-printed rolls are produced using offset technology. In offset technology, inked image is transferred or "offset" from a plate to an intermediate surface (e.g., rubber blanket), and then to the printing surface.

Full color digital web printers with the capability to produce excellent graphics are now being offered. The transition from preprinted forms to execute the entire print job in one machine may take some time, because the transition requires not only substituting monochrome printers but also, for example, changing the workflow, etc.

The use of preprinted forms presents a problem for the registration strategy of the continuous feed direct marking printer. That is, the registration control target that is printed on top of the pre-printed form is confounded with the pre-printed form. This issue (i.e., the registration control target is confounded with the pre-printed form) precludes the actual analysis of the x- and y-positions of the print heads.

The present disclosure provides improvements in registration strategy of preprinted forms.

SUMMARY

According to one aspect of the present disclosure, a computer-implemented method for performing color registration on template media having template markings thereon is provided. The method is implemented in a computer system comprising one or more processors configured to execute one or more computer program modules. The method includes sensing the template media using a linear array sensor positioned along a process path of a web to obtain first image data; printing a test pattern on the template media; sensing the template media along with the test pattern printed thereon using the linear array sensor to obtain second image data; transforming the first image data and the second image data into an absorbance space to obtain a first absorbance and a second absorbance, respectively; determining a difference between the first absorbance and the second absorbance to obtain an output absorbance; transforming the output absorbance into a reflectivity space to obtain an output data; determining a process direction misregistration and a cross-process direction misregistration from the output data; and adjusting a cross-process position and a process position of print heads based on the process direction misregistration and cross-process direction misregistration to provide accurate color registration on subsequent template media. The output absorbance is representative of absorbance corresponding to the test pattern. The output data is representative of image data of the test pattern.

According to another aspect of the present disclosure, a system for performing color registration on template media having template markings thereon is provided. The system includes a print engine, a linear array sensor, a processor, and a controller. The print engine is configured to print a test pattern on the template media. The linear array sensor is positioned along a process path of a web. The linear array sensor is configured to sense a) the template media to obtain first image data; and b) the template media along with the test pattern printed thereon to obtain second image data. The processor is configured to a) transform the first image data and the second image data into an absorbance space to obtain a first absorbance and a second absorbance, respectively; b) determine an output absorbance by calculating a difference between the first absorbance and the second absorbance; c) transform the output absorbance into a reflectivity space to obtain an output data; and d) determine a process direction misregistration and a cross-process direction misregistration from the output data. The controller is configured to adjust a cross-process position and a process position of print heads based on the process direction misregistration and cross-process direction misregistration to provide accurate color registration on subsequent template media. The output absorbance is representative of absorbance corresponding to the test pattern. The output data is representative of image data of the test pattern.

According to another aspect of the present disclosure, a computer-implemented method for performing color registration on template media having template markings thereon is provided. The method is implemented in a computer system comprising one or more processors configured to execute one or more computer program modules. The method includes sensing the template media using a linear array sensor positioned along a process path of a web to obtain first image data; printing a test pattern on the template media; sensing the template media along with the test pattern printed thereon using the linear array sensor to obtain second image data; analyzing the second image data to obtain an output image data; determining a process direction misregistration and a cross-process direction misregistration from the output image data; and adjusting a cross-process position and a process position of print heads based on the process direction misregistration and cross-process direction misregistration to provide accurate color registration on subsequent template media.

According to another aspect of the present disclosure, a computer-implemented method for performing color registration on template media having template markings thereon is provided. The method is implemented in a computer system comprising one or more processors configured to execute one or more computer program modules. The method includes sensing the template media using a linear array sensor positioned along a process path of a web to obtain first image data; printing a test pattern on the template media; sensing the template media along with the test pattern printed thereon using the linear array sensor to obtain second image data; transforming the first image data and the second image data into a reflectivity space to obtain a first reflectivity and a second reflectivity, respectively; determining a ratio of the second reflectivity and the first reflectivity to obtain an output reflectivity; obtaining an output image data from the output reflectivity; determining a process direction misregistration and a cross-process direction misregistration from the output image data; and adjusting a cross-process position and a process position of print heads based on the process direction misregistration and cross-process direction misregistration to provide accurate color registration on subsequent template media. The output reflectivity is representative of reflectivity corresponding to the test pattern, and the output image data is representative of image data of the test pattern.

According to another aspect of the present disclosure, a computer-implemented method for performing color registration on template media having template markings thereon is provided. The method is implemented in a computer system comprising one or more processors configured to execute one or more computer program modules. The method includes sensing the template media using a linear array sensor positioned along a process path of a web to obtain first image data; printing a test pattern on the template media; sensing the template media along with the test pattern printed thereon using the linear array sensor to obtain second image data; analyzing the second image data to obtain an output image data; analyzing both the first image data and the second image data to obtain the output image data, if the analysis of the second image data fails to obtain the output image data; determining a process direction misregistration and a cross-process direction misregistration from the output image data; and adjusting a cross-process position and a process position of print heads based on the process direction misregistration and cross-process direction misregistration to provide accurate color registration on subsequent template media. The output image data is representative of image data of the test pattern.

Other objects, features, and advantages of one or more embodiments of the present disclosure will seem apparent from the following detailed description, and accompanying drawings, and the appended claims.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

Figure 1:
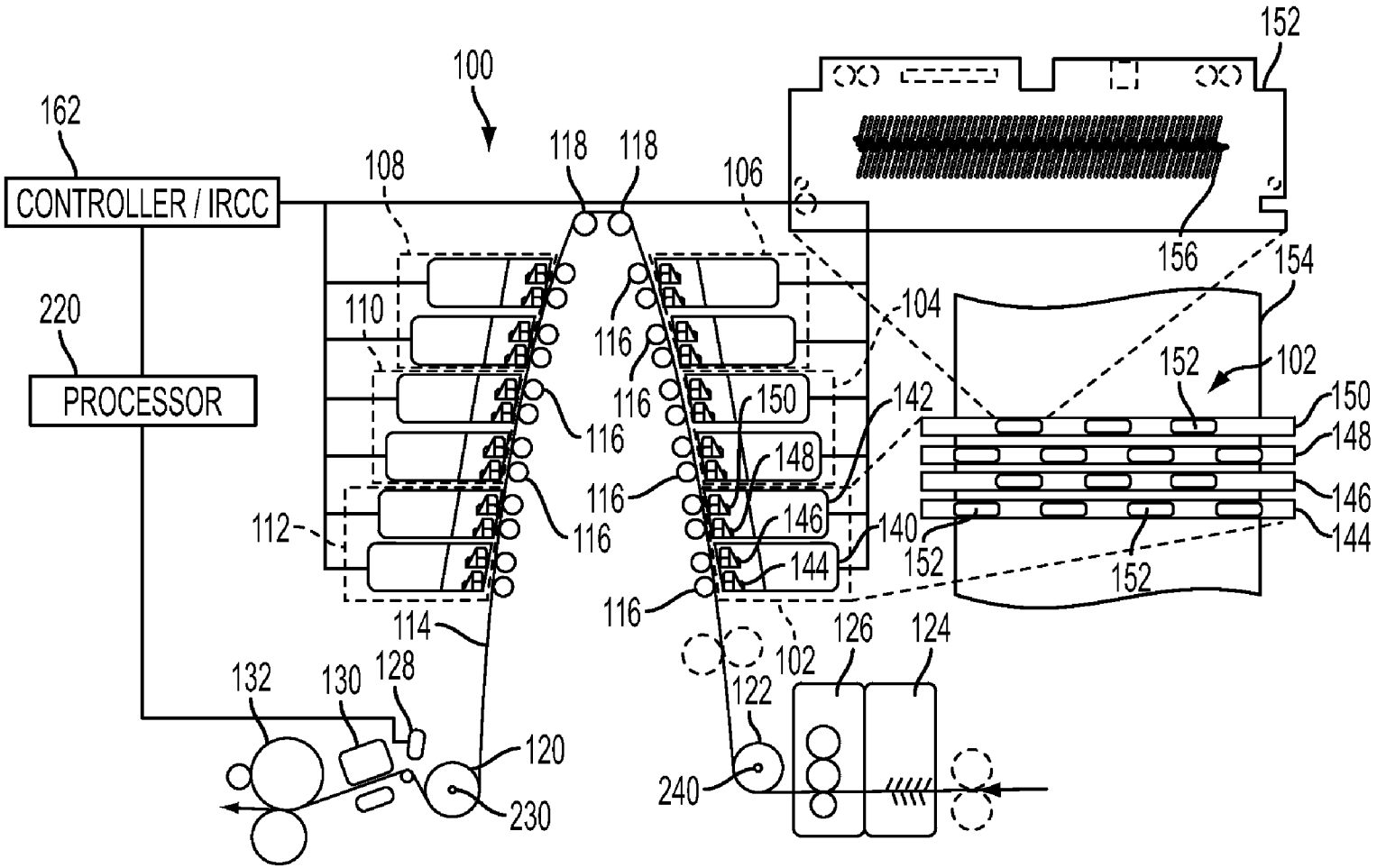
FIG. 1 illustrates a schematic view of a continuous web printing system with twelve print modules along with expanded schematic views showing print heads positioned within print sub-modules and nozzles within a print head.

FIG. 1 illustrates a continuous web printer system 100. The continuous web printing system 100 includes a print engine, a linear array sensor or an Image On Web Array (IOWA) sensor 128, a processor 220 and a controller 240.

The continuous web printer system 100 also includes a web supply and handling system that is configured to supply a very long (i.e., substantially continuous) web 154 of "substrate" or "media" (e.g., paper, plastic or other printable material) from a spool (not shown). In another embodiment, the web 154 is in the form of an extensible image receiving member, such as a belt, which defines an image receiving surface that is driven in a process direction between print modules of the print engine. The web 154 may be unwound as needed, and propelled by a variety of motors, not shown. The web supply and handling system is capable of transporting the web 154 at a plurality of different speeds. In one embodiment, the web 154 is capable of being moved at any speed between approximately zero inches per second (ips) and approximately 150 inches per second (ips). A set of rolls are configured to control the tension of the unwinding web as the web moves through the path 114.

In the present disclosure, the process direction is the direction in which the web, onto which the image is transferred and developed, moves through the image transfer and developing apparatus. The cross-process direction, along the same plane as the web, is substantially perpendicular to the process direction.

The print engine of the continuous web printing system 100 includes a series of print (or color) modules 102, 104, 106, 108, 110, and 112, each print module 102, 104, 106, 108, 110, and 112 effectively extending across the width of the web 154 in the cross-process direction. The print engine is configured to print a test pattern on a template media (having template markings thereon). As shown in FIG. 1, the print modules 102, 104, 106, 108, 110, and 112 are positioned sequentially along the in-track axis of a process path 114 defined in part by rolls 116. The process path 114 is further defined by upper rolls 118, leveler roll 120 and pre-heater roll 122. A brush cleaner 124 and a contact roll 126 are located at one end of the process path 114. The Image On Web Array (IOWA) sensor 128, a heater 130 and a spreader 132 are located at the opposite end of the process path 114.

Each print module 102, 104, 106, 108, 110, and 112 is configured to provide an ink of a different color. Six print modules are shown in FIG. 1 although more or fewer print modules may be used. In all other respects, the print modules 102, 104, 106, 108, 110, and 112 are substantially identical. Accordingly, while only print module 102 will be further described in detail, such description further applies to the print modules 104, 106, 108, 110, and 112.

Print module 102 includes two print sub modules 140 and 142. Print sub module 140 includes two print units 144 and 146 and print sub module 142 includes two print units 148 and 150. The print units 144 and 148 each include four print heads 152 while the print units 146 and 150 each include three print heads 152. Thus, each of the print sub modules 140 and 142 include seven offset print heads 152. The print heads 152 are offset to provide space for positioning of control components. The use of multiple print heads 152 allows for an image to be printed on the web 154, which is much wider than an individual print head 152. Therefore, by enabling different combinations of print heads, multiple web widths may be used to print images of various widths. For example, seven print heads 152, which are each approximately 2.9 inches wide, may be used to produce up to approximately 20 inches image on the web 154. The print width of the exemplary print module 102 may be increased or decreased by adding or eliminating print heads to each two print sub modules.

Each of the print heads 152 includes sixteen rows of nozzles 156. Each of the nozzles 156 is individually controlled to jet a spot of ink on the web 154. The matrix of nozzles 156 in one embodiment provides a density of 300 nozzles per inch in the cross-process direction of the process path 114. Accordingly, each print head 152 produces an image with a spot density of 300 spots of ink per inch (SPI).

The provision of two sub modules, such as sub modules 140 and 142, for each of the print modules 102, 104, 106, 108, 110, and 112 provides increased resolution. Specifically, the print heads 152 in the sub modules 142 are offset in the cross-process direction of the process path 114 with respect to the print heads 152 in the sub module 140 by a distance corresponding to the width of a spot or a pixel in a print head configured to provide 600 SPI. The resultant interlacing of the jets produced by the nozzles 152 generates an image with a 600 SPI resolution. It is contemplated that increasing printing resolutions may be achieved by utilizing single print heads of higher nozzle density.

Figure 2:
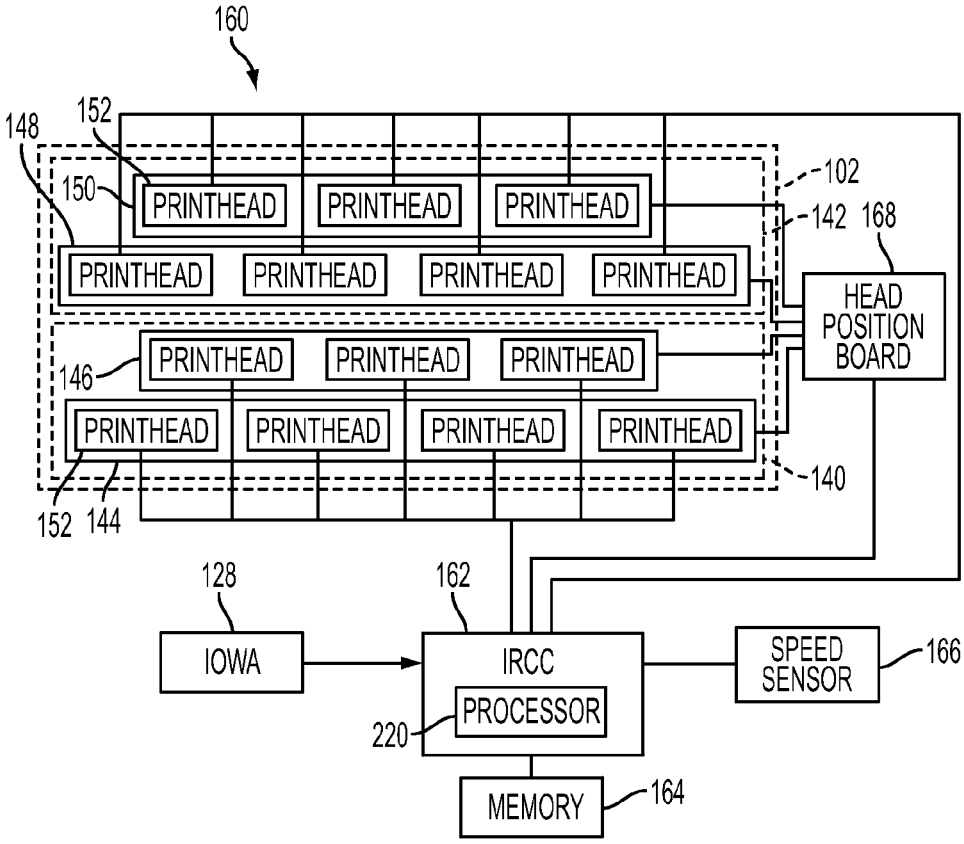
FIG. 2 illustrates a schematic of a control system that may be used with the system of FIG. 1 for performing color registration on template media having template markings thereon in accordance with an embodiment of the present disclosure.

As shown in FIGS. 1 and 2, the multiple print heads are distributed in a print zone over a long span of the web 154. The position of the print heads is determined using the Integrated Registration and Color Control (IRCC) technology. This IRCC technology includes the IOWA sensor 128, and an IRCC board or controller 162 to adjust process (y) and cross-process (x) direction distances between print heads. The IRCC board or controller 162 may include the processor 220 (i.e., signal processing and control algorithms, and actuator electronics to determine process (y) and cross-process (x) direction distances between print heads).

Alignment of the print modules 102, 104, 106, 108, 110, and 112 with the process path 114 is controlled by a control system 160 shown in FIG. 2 (only print module 102 is shown in FIG. 2). The control system 160 may be used with the system of FIG. 1 to control generation and detection of test patterns (or registration patterns) and to control the process position and the cross-process position of print heads.

The control system 160 includes an Integrated Registration and color Control (IRCC) board or controller 162 and a memory 164. The IRCC board 162 is connected to the IOWA sensor 128, and includes the processor 220 and a speed sensor 166, which detects the speed at which the web 154 moves along the process path 114. The IRCC board or controller 162 is further connected to each of the print heads 152 to control jetting of the nozzles 156, and a head position board 168.

The IOWA sensor 128 is a full width image contact sensor, which monitors the ink on the web 154 as the web 154 passes under the IOWA sensor 128. In general, such a full width linear array sensor may be positioned upstream of the print heads to capture the template media (or the pre-printed form) or may be positioned downstream of the print heads for image-quality check. When there is ink on the web 154, the light reflection off of the web 154 is low and when there is no ink on the web 154, the amount of reflected light is high. When a pattern of ink is printed by one or more of the print heads 152 under the control of the IRCC board 162, the IOWA sensor 128 may be used to sense the printed mark and provide a sensor output to the processor 220. Such a full width array sensor that is used in a print head registration correction system to achieve the image registration in the direct marking continuous web printers is described in U.S. Patent Application Publication No. 2008/0062219, hereby incorporated by reference in its entirety, and hence will not be explained in detail here.

As shown in FIG. 1, the linear array sensor 128 is positioned along the process path 114 (as shown in FIG. 1) of the web 154. When performing the registration strategy for pre-printed forms, a default sensor calibration that is stored in the sensor is used. In contrast, when performing the registration strategy for a blank paper, the sensor calibration is executed during every Cycle Up. In one embodiment, as shown in FIG. 1, the linear array sensor 128 is positioned upstream of the print heads to capture the pre-printed form or template media. The linear array sensor 128 is configured to sense a) the template media to obtain first image data; and b) the template media along with the test pattern printed thereon to obtain second image data.

In one embodiment, the template media is in the form of a continuous web having a plurality of template media. In one embodiment, the template media moves at 300 ft/min for high-quality applications and at 600 ft/min for low-quality applications. A first template media of the continuous web is sensed using the linear array sensor 128 positioned along the process path 114 of the web to obtain the first image data. A second or subsequent template media (with the test pattern printed thereon) of the continuous web is sensed using the linear array sensor 128 positioned along the process path 114 of the web to obtain the second image data.

In other words, the first template media of the continuous web is sensed using the linear array sensor 128 to obtain the linear array sensor response profile of the template media with template markings thereon (i.e., the first image data), then the test pattern is printed on the second or subsequent template media and the second or subsequent template media (i.e., along with the test pattern printed thereon) of the continuous web is sensed using the linear array sensor 128 to obtain the linear array sensor response profile of the template media along with the test pattern printed thereon (i.e., the second image data). The linear array sensor 128 is configured to provide the first image data and the second image data to the processor 220.

In one embodiment, the processor 220 can comprise either one or a plurality of processors therein. Thus, the term "processor" as used herein broadly refers to a single processor or multiple processors. In one embodiment, the processor 220 can be a part of or forming a computer system. In one embodiment, the processor 220 can be a part of the Integrated Registration and Color Control (IRCC) board 162 (as shown in FIG. 2).

In one embodiment, the processor 220 of the system 160 may be configured to select method or mode 300 (as described and show in detail with respect to FIG. 3A), method or mode 300' (as described and show in detail with respect to FIG. 3B), the method or mode 400 (as described and show in detail with respect to FIG. 4), or the method or mode 500 (as described and show in detail with respect to FIG. 5) based on the content of the template media (i.e., preprinted form).

The method or mode 300' (as described and show in detail with respect to FIG. 3B) that is similar to the method or mode 300 (as described and show in detail with respect to FIG. 3A), except for the differences in processing the first image data and the second image data as will be noted below with respect to FIG. 3B.

The processor 220 of the system 160 may be configured to select either method or mode 300' (as described and show in detail with respect to FIG. 3B) or method or mode 300 (as described and show in detail with respect to FIG. 3A) when the pre-printed image content (i.e., template markings) on the template media is high, and select the method or mode 400 when the pre-printed image content (i.e., template markings) on the template media is low.

The method 500 (as described and show in detail with respect to FIG. 5) is a combination of methods 300 and 400, or a combination of methods 300' and 400. The method 500 includes an automatic criterion that is used to decide between high pre-printed content and low pre-printed content.

If the method or mode 300 is selected, the processor 220 is configured to a) transform the first image data and the second image data into an absorbance space to obtain a first absorbance and a second absorbance, respectively; b) determine an output absorbance by calculating a difference between the first absorbance and the second absorbance, the output absorbance being representative of absorbance corresponding to the test pattern; c) transform the output absorbance into a reflectivity space to obtain an output data, the output data being representative of image data of the test pattern; and d) determine a process direction misregistration and a cross-process direction misregistration from the output data. The method or mode 300 is explained in detail below with respect to FIG. 3A. If the method or mode 300' is selected, the processor 220 is configured to (a) transform the first image data and the second image data into a reflectivity space to obtain a first reflectivity and a second reflectivity, respectively; (b) determine a ratio of the second reflectivity and the first reflectivity to obtain an output reflectivity; and (c) obtain the output image data from the output reflectivity; and d) determine a process direction misregistration and a cross-process direction misregistration from the output image data. The output reflectivity is representative of reflectivity corresponding to the test pattern and the output image data is representative of image data of the test pattern. The method or mode 300' is explained in detail below with respect to FIG. 3B.

If the method or mode 400 is selected, the processor 220 is configured to a) analyze the second input image data to obtain an output image data; and b) determine a process direction misregistration and a cross-process direction misregistration from the output image data. The method or mode 400 is explained in detail below with respect to FIG. 4.

In one embodiment, the processor 220 uses the output data to determine the cross-process position of the nozzles 156 for the print units 144, 146, 148, and 150 within the print module 102 (along with the nozzles 156 for the print units within the print modules 104, 106, 108, 110, and 112). Based upon the relative positions, the processor 220 determines cross-process corrections for the print units 144, 146, 148, and 150. In other words, the processor 220 is configured to analyze the output data to determine x-position and y-position of each print head. In one embodiment, a registration algorithm (i.e., procedures 390 and 395 as shown and explained with respect to FIG. 3A) of the processor 220 uses the amplitude of a repeating pattern at the expected spacing between dashes of the test pattern to compute the x-position and y-position of each print head.

The system and method for determining registration errors in the cross-process direction is described in U.S. Patent Application Publication No. 2008/0062219, hereby incorporated by reference in its entirety, and hence will not be explained in detail here. U.S. patent application Publication Ser. No. 12/274,566 (filing date: Nov. 20, 2008), hereby incorporated by reference in its entirety, describes a print head registration correction system and method for use with direct marking continuous web printers. This print head registration correction system uses a full width array sensor to achieve the image registration in the direct marking continuous web printers. U.S. Patent Application Publication No. 2009/0265950, hereby incorporated by reference in its entirety, describes registration system for a continuous web printer.

In one embodiment, y-registration (i.e., process direction registration) of the image is achieved by a double reflex printing technology that determines jet timing of each print head based on web motion measured by encoders 230, 240 (as shown in FIG. 1) and tensiometers. The double reflex printing technology is described in U.S. Pat. No. 7,665,817, hereby incorporated by reference in its entirety, and hence will not be explained in detail here. This patent application provides a more detailed description of a double reflex printing registration system and different methods of determining the double reflex printing offsets based on time varying changes in tension of the web. The double reflex printing registration system is configured to determine a double reflex printing offset for each print head positioned along the web path which may be used to control system 160 to adjust the predetermined actuation time for each print head so that each image applied by the various print heads is correctly registered on the web to form the desired composite color image.

In one embodiment, the print head displacement offsets (i.e., process and cross-process direction misregistrations) may be used in conjunction with double reflex printing offsets to adjust actuation times for the print heads to compensate for registration errors that may be introduced due to time varying changes in tension of the web as well as registration errors that may be introduced due to print head displacement that may occur over a period of time.

The controller or IRCC 162 is configured to adjust a cross-process position and a process position of print heads based on the process direction misregistration and cross-process direction misregistration to provide accurate color registration on subsequent template media.

The IRCC board or controller 162 receives the process direction misregistration and the cross-process direction misregistration from the processor 220 and then the passes the process direction misregistration and the cross-process direction misregistration to the head position board 168, which in turn controls the cross-process position of the print units 144, 146, 148, and 150. In one embodiment, the computed process and cross-process misregistrations are corrected by y-registration actuators and x-registration actuators. The position of the print units 144, 146, 148, and 150 may be individually controlled using stepper motors configured to change the location of the associated print units 144, 146, 148, or 150 in one micron increments. Alternatively, piezoelectric motors may be used to reduce the potential for backlash when changing direction of the motors.

As explained above, the present disclosure proposes three embodiments (i.e., method 300 (or 300'), method 400, and method 500). The method 300 or 300' is used when the pre-printed image content (i.e., template markings) on the template media is high, and the method or mode 400 is used when the pre-printed image content (i.e., template markings) on the template media is low. As noted above, the method 500 (as described and show in detail with respect to FIG. 5) is a combination of both methods 300 (or 300') and 400. The method 500 includes an automatic criterion that is used to decide between high pre-printed content and low pre-printed content.

The procedure of printing and capturing the images of the pre-printed form and of the registration target printed on the pre-printed form is common in all the embodiments (i.e., method 300 or 300', method 400, and method 500). As will be explained below, the difference between the embodiments (i.e., method 300 or 300', method 400, and method 500) is in the processing of the images.

Figure 3A:
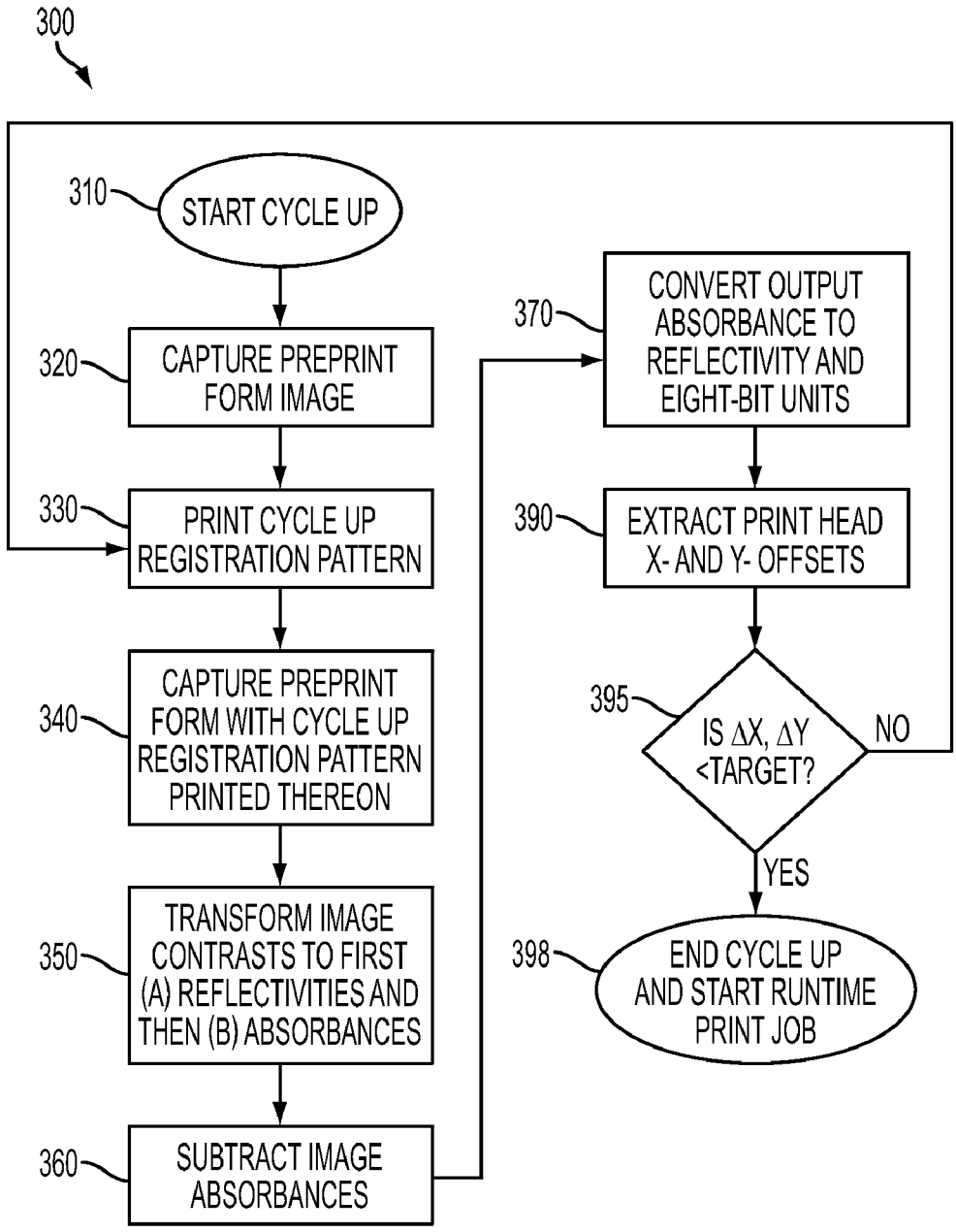
FIG. 3A illustrates a method for performing color registration on template media having template markings thereon in accordance with an embodiment of the present disclosure.

FIG. 3A provides the method 300 for performing color registration on template media having template markings thereon. The method 300 is a computer-implemented method that is implemented in a computer system comprising one or more processors 220 (as shown in and explained with respect to FIGS. 1 and 2) configured to execute one or more computer program modules.

The method 300 includes, during Cycle Up, sensing a blank preprinted form using the IOWA sensor 128, printing the control registration target (or test pattern) on the blank preprinted form, and sensing the control registration target using the IOWA sensor 128, then using known signal processing techniques (and concepts of optical physics and modern digital image processing techniques) to differentiate the pre-printed form image from the control registration target image ("subtract") and execute the IRCC (i.e., Integrated Registration and Color Control) analysis on the processed registration image.

Figure 8A:
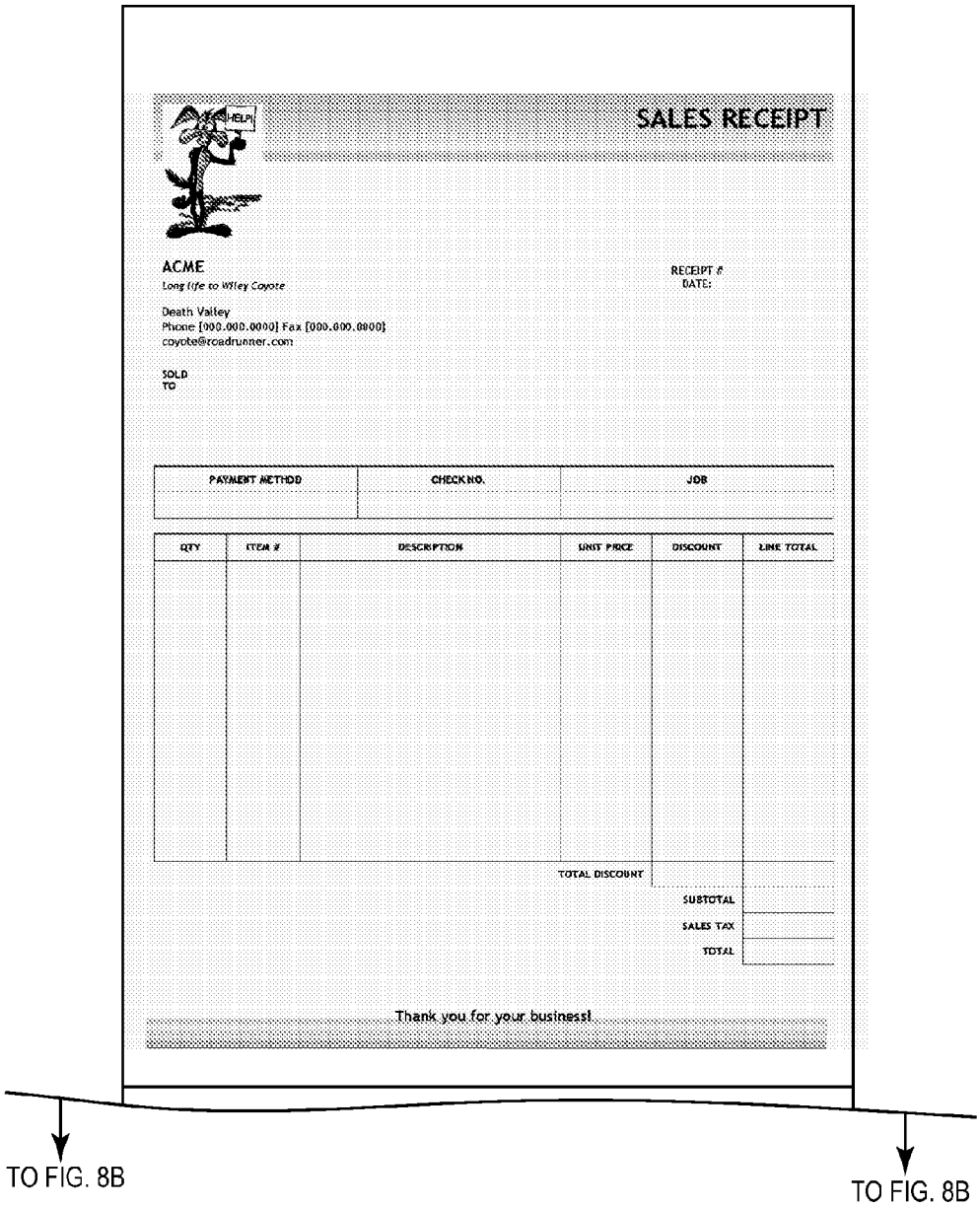
FIGS. 8A and 8B illustrate an exemplary template media having template markings thereon in a two-up configuration as captured by a linear array sensor in accordance with an embodiment of the present disclosure.
Figure 8B:
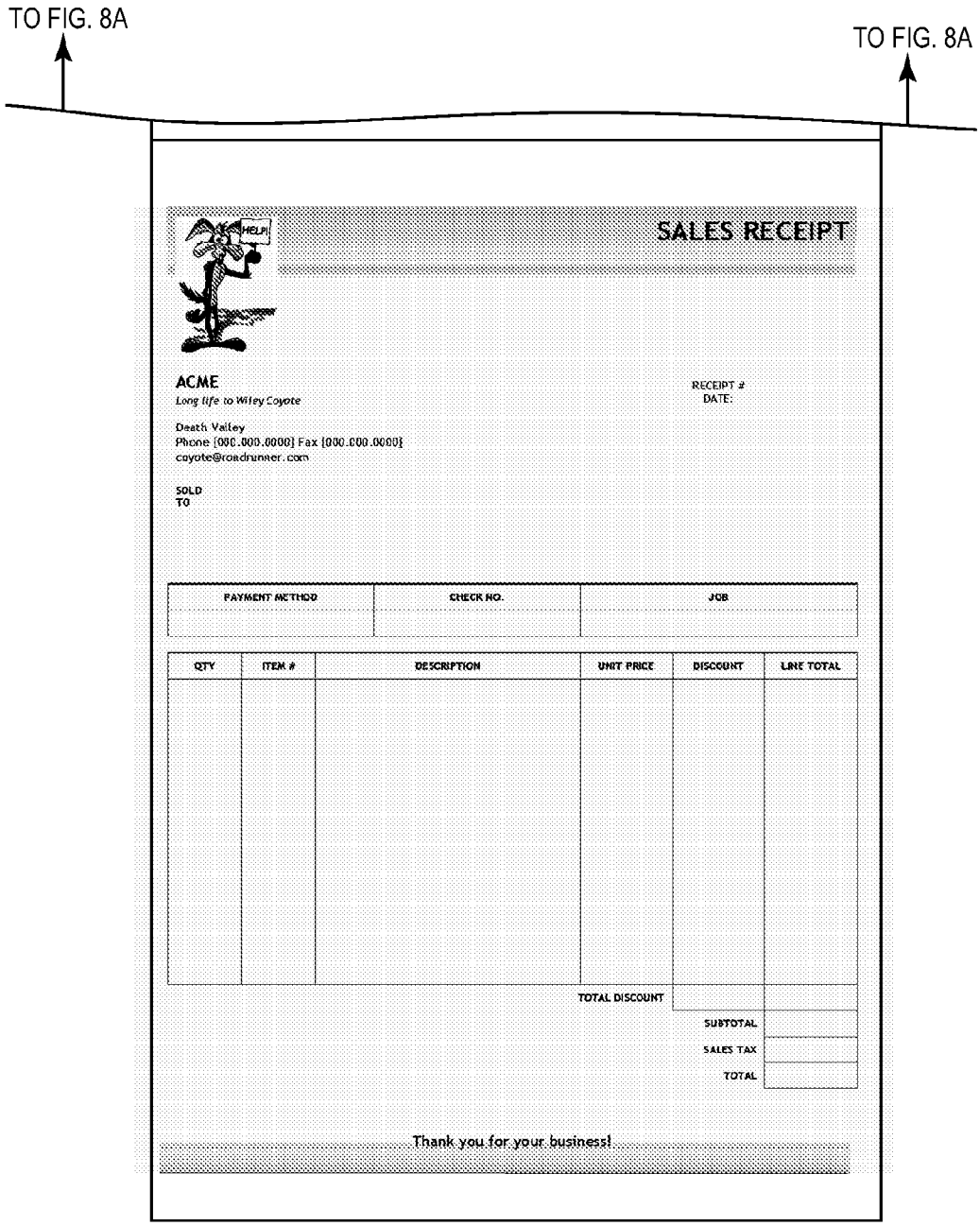

The method 300 begins at procedure 310, where cycle up of the continuous web printer system 100 is started. The method 300 then proceeds to procedure 320. At procedure 320, the template media having template markings thereon is sensed using the linear array sensor 128 (i.e., IOWA sensor 128) positioned along the process path 114 of a web to obtain first image data. In one embodiment, such linear array sensor may be positioned upstream of the print heads to capture the template media (or the pre-printed form). FIGS. 8A and 8B illustrates a simulated captured template media. The captured template media is repeated twice and is in two-up configuration (i.e., 20" wide paper). The first image data is a linear array sensor response profile of the template media with template markings thereon.

Figure 6:
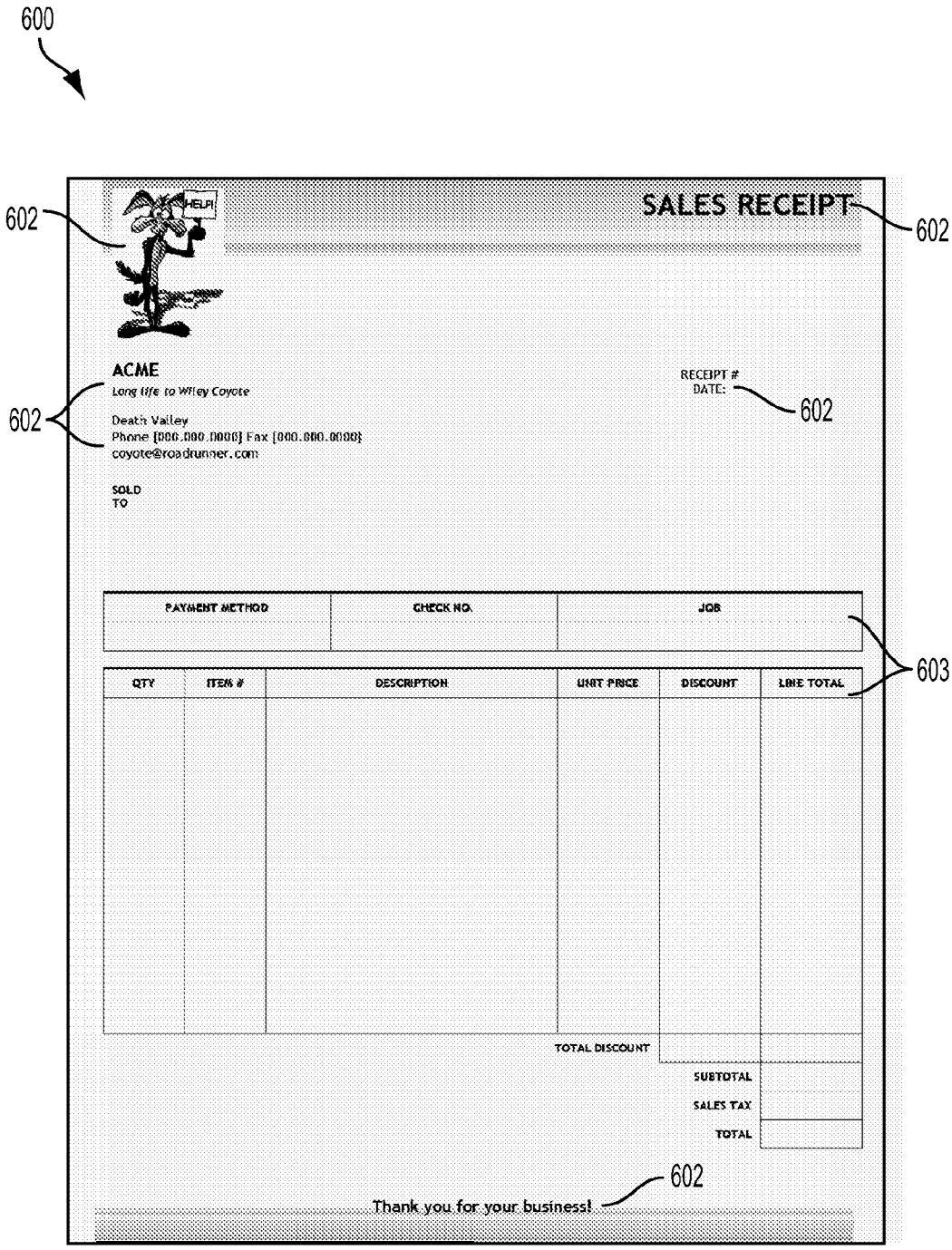
FIG. 6 illustrates an exemplary template media having template markings thereon in accordance with an embodiment of the present disclosure.

An exemplary template media 600 having template markings thereon is illustrated in FIG. 6. The exemplary template media 600 as shown in FIG. 6 is a pre-printed form of a sales receipt. In one embodiment, as shown in FIG. 6, the template markings include form images 601, marks, report formats, banners, logos 601, letterhead, data heading for spaces for data, pre-printed text 602, pre-printed boxes 603, pre-printed lines, and/or questions with corresponding spaces for answers.

Figure 7:
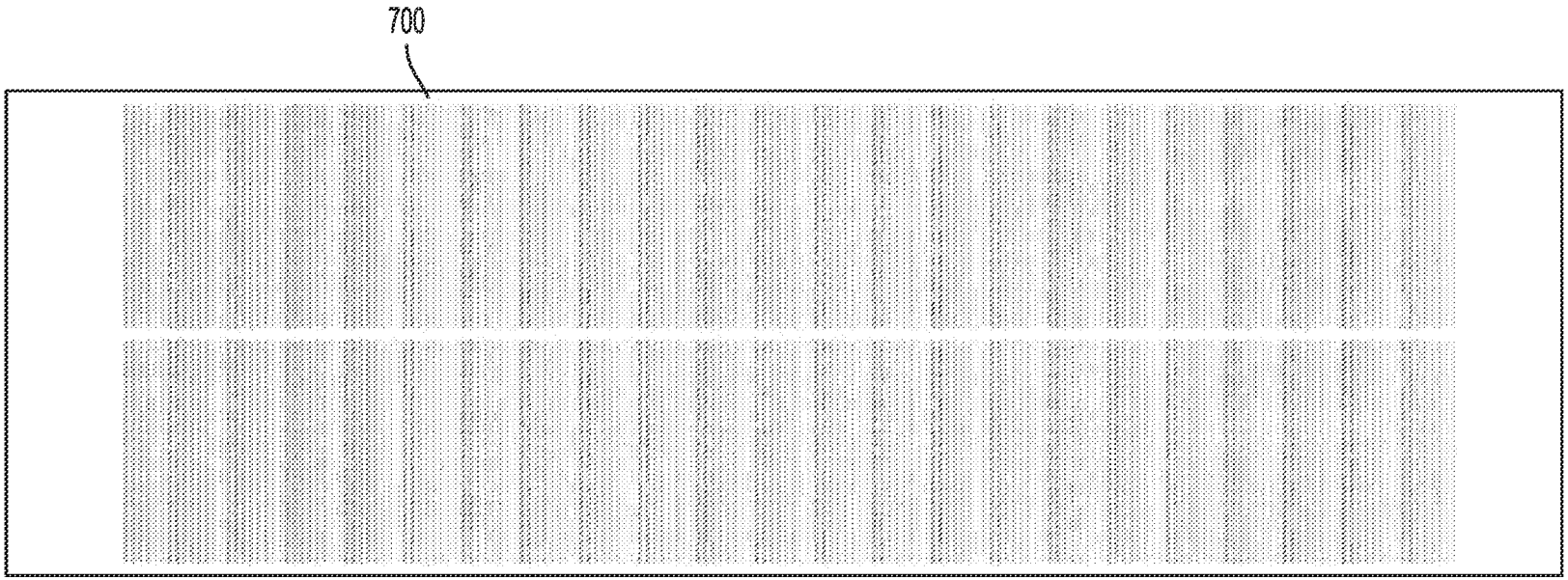
FIG. 7 illustrates an exemplary test pattern (i.e., repeated twice) in a two-up configuration printed on a blank paper in accordance with an embodiment of the present disclosure.

At procedure 330, during cycle up, a test pattern 700 (as shown in FIG. 7) is printed on the template media 600. An exemplary test pattern 700 is illustrated in FIG. 7. In one embodiment, the test pattern 700 comprises a plurality of dashes, the dashes being process direction dashes. The test pattern 700, as shown in FIG. 7, is repeated twice and is in two-up configuration (i.e., 20" wide paper) printed on a blank media or paper. The test pattern 700 includes repeated single pixel dashes, 20 pixels long, addressing all the print heads in the system.

Figure 9A:
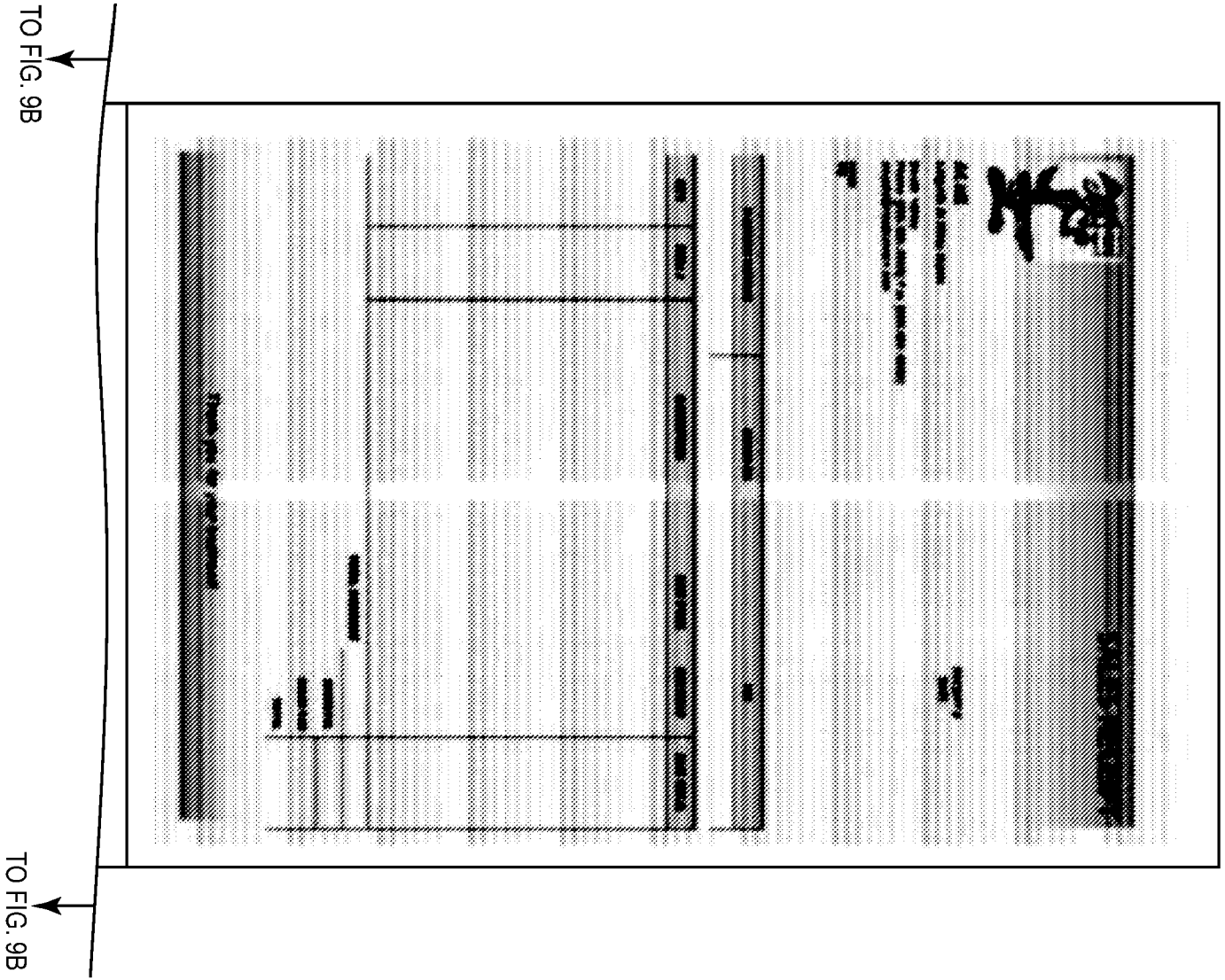
FIGS. 9A and 9B illustrate an exemplary template media along with the test pattern printed thereon in a two-up configuration as captured by the linear array sensor in accordance with an embodiment of the present disclosure.
Figure 9B:
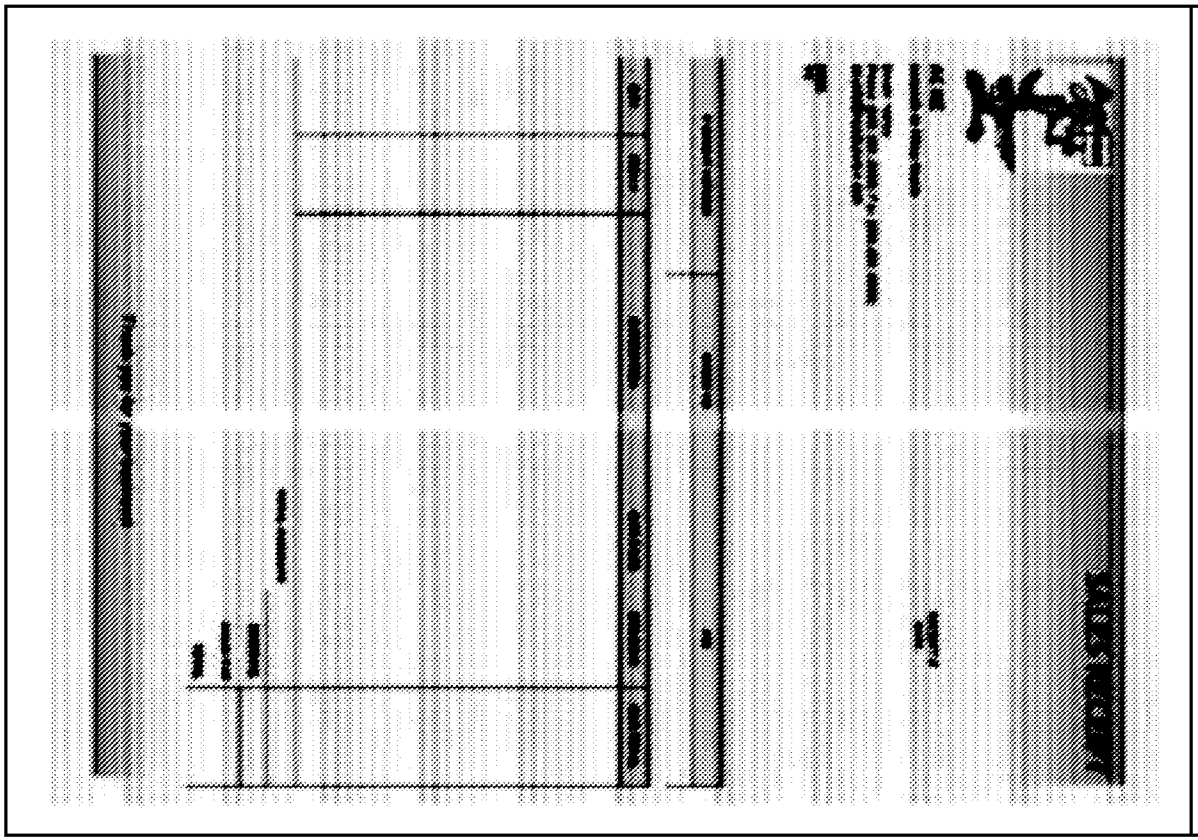

The method 300 then proceeds to procedure 340, where the template media along with the test pattern printed thereon is sensed or captured using the linear array sensor 128 to obtain second image data. The second image data is a linear array sensor response profile of the template media along with the test pattern printed thereon. FIGS. 9A and 9B illustrates a simulated captured template media along with the test pattern printed thereon. The captured template media along with the test pattern printed thereon are repeated twice and are in two-up configuration (i.e., 20" wide paper).

In one embodiment, the template media is in the form of a continuous web having a plurality of template media. A first template media of the continuous web is sensed using the linear array sensor 128 positioned along the process path 114 of the web to obtain the first image data. A second or subsequent template media (with the test pattern printed thereon) of the continuous web is sensed using the linear array sensor 128 positioned along the process path 114 of the web to obtain the second image data.

In other words, the first template media of the continuous web is sensed using the linear array sensor 128 to obtain the linear array sensor response profile of the template media with template markings thereon, then the test pattern is printed on the second or subsequent template media and the second or subsequent template media (i.e., along with the test pattern printed thereon) of the continuous web is sensed using the linear array sensor 128 to obtain the linear array sensor response profile of the template media along with the test pattern printed thereon.

The first image data (shown in FIGS. 8A and 8B) consists of a two-dimensional array of sensor response values. Similarly, the second image data (shown in FIGS. 9A and 9B) consists of a two-dimensional array of sensor response values.

At procedure 350, the method 300 is configured to transform the first image data and the second image data first into reflectivity space and then into an absorbance space to obtain a first absorbance and a second absorbance, respectively.

The first image data is transformed into reflectivity space by dividing the first image data (i.e., linear array sensor response profile of the template media with template markings thereon) by 255 (i.e., eight-bit grayscale space), according to the Equation (1):

$$\text{firstimagedata}(x,y)(\text{inreflectivityspace})=(ppf(x,y)/255) \quad \text{Equation (1)}$$

where ppf (x, y) is the first image data as sensed by the sensor at location (x, y); and 255 is eight-bit grayscale space.

The second image data is transformed into reflectivity space by dividing the second image data (i.e., linear array sensor response profile of the template media along with the test pattern printed thereon) by 255 (i.e., eight-bit grayscale space), according to the Equation (2):

$$\text{sec on dim agedata}(x,y)(\text{inreflectivityspace})=(ppf_rt(x,y)/255) \quad \text{Equation (2)}$$

where ppf_rt(x, y) is the second image data as sensed by the sensor at location (x, y); and 255 is eight-bit grayscale space.

In one embodiment, ppf (x, y) and ppf_rt(x, y) is a number that lies within the range of 0-255. Therefore, the first image data that is obtained from Equation (1) is a number that lies within the range of 0-1. Similarly, the second image data obtained from Equation (2) is a number that lies within the range of 0-1.

The first absorbance is obtained by talking a decimal logarithm for the first image data (i.e., in reflectivity space), according to the Equation (3):

$$a_ppf(x,y)=\log_{10}(ppf(x,y)/255) \quad \text{Equation (3)}$$

where a_ppf(x, y) is the first absorbance;
ppf(x, y) is the first image data; and
255 is eight-bit grayscale space.

In other words, ppf(x, y) is the first image data as sensed by the sensor at location (x, y), while (ppf(x, y)/255) and a_ppf (x, y) are corresponding reflectivity and corresponding absorbance at that location.

The second absorbance is obtained by talking a decimal logarithm for the second image data (i.e., in reflectivity space), according to the Equation (4):

$$a_ppf_rt(x,y)=\log_{10}(ppf_rt(x,y)/255) \quad \text{Equation (4)}$$

where a_ppf_rt(x, y) is the second absorbance;
ppf_rt(x, y) is the second image data; and
255 is eight-bit grayscale space.

In other words, ppf_rt(x, y) is the second image data as sensed by the sensor at location (x, y), while (ppf_rt(x, y)/255) and a_ppf_rt(x, y) are corresponding reflectivity and corresponding absorbance at that location.

It should be appreciated that the foregoing equations (i.e., Equation (3) and Equation (4)) denote the conversion of the linear array sensor response profiles from a pure reflectivity space (e.g., a color space such as RGB) to density space.

The captured template media (i.e., the first image data, as shown in FIGS. 8A and 8B) and the captured template media along with the test pattern printed thereon (i.e., the second image data, as shown in FIGS. 9A and 9B) are transformed first into reflectivity space and then into absorbance space. The image data is transformed into the absorbance space so as to subtract the absorbances of the two images (i.e., the template media and the template media with the test pattern printed thereon) and obtain the output absorbance (i.e., absorbance of the test pattern). In other words, the reflectivity is not an additive quantity and is generally in a percentage form, thus, the data in the reflectivity space cannot be subtracted. Therefore, the data is converted into absorbance space to calculate the difference between the captured template media (i.e., the first image data, as shown in FIGS. 8A and 8B) and the captured template media along with the test pattern printed thereon (the second image data, as shown in FIGS. 9A and 9B).

At procedure 360, the method 300 is configured to determine a difference between the first absorbance a_ppf(x, y) and the second absorbance a_ppf_rt(x, y) to obtain an output absorbance. The output absorbance is representative of absorbance corresponding to the test pattern. The output absorbance is determined according to the Equation (5):

$$a_rt(x,y)=a_ppf_rt(x,y)-a_ppf(x,y) \quad \text{Equation (5)}$$

where a_rt(x, y) is the output absorbance;
a_ppf_rt(x, y) is the second absorbance; and
a_ppf(x, y) is the first absorbance.

At procedure 370, the method 300 is configured to transform the output absorbance a_rt(x, y) into a reflectivity space to obtain an output data. The output data is representative of image data of the test pattern. The output data is obtained by taking an exponential function of the output absorbance, according to the Equation (6):

$$r_rt(x,y)=10^{-a_rt(x,y)} \quad \text{Equation (6)}$$

where r_rt(x, y) is the output data; and
a_rt(x, y) is the output absorbance.

It should be appreciated that the foregoing equation (i.e., Equation (6)) converts absorbance (i.e., corresponding to the test pattern) in the density space to the image data of the test pattern in the reflectivity space (i.e., its original color space).

At procedure 390, the method 300 is configured to determine a process direction misregistration and a cross-process direction misregistration from the output data (i.e., image data of the test pattern).

Methods for analyzing images of dashes in a test pattern to identify the process and cross-process positions of the dashes and their centers are disclosed in co-pending patent applications entitled "Test Pattern Effective For Coarse Registration Of Inkjet Printheads And Method Of Analysis Of Image Data Corresponding To The Test Pattern In An Inkjet Printer" [Xerox ID: 20091686] having Ser. No. 12/754,730, which was filed on even date herewith and "Test Pattern Effective For Fine Registration Of Inkjet Printheads And Method Of Analysis Of Image Data Corresponding To The Test Pattern In An Inkjet Printer" [Xerox ID: 20091786] having Ser. No. 12/754,735, which was filed on even date herewith, both of which are commonly owned by the assignee of the present disclosure. These two co-pending patent applications are herein incorporated by reference in their entirety.

In one embodiment, y-registration (i.e., process direction registration) of the image is achieved by a double reflex printing technology that determines jet timing of each print head based on web motion measured by encoders 230, 240 (as shown in FIG. 1) and tensiometers. The double reflex printing technology is described in U.S. Pat. No. 7,665,817, hereby incorporated by reference in its entirety, and hence will not be explained in detail here. This patent application provides a more detailed description of a double reflex printing registration system and different methods of determining the double reflex printing offsets based on time varying changes in tension of the web. The double reflex printing registration system is configured to determine a double reflex printing offset for each print head positioned along the web path which may be used to control system 160 to adjust the predetermined actuation time for each print head so that each image applied by the various print heads is correctly registered on the web to form the desired composite color image.

In one embodiment, the print head displacement offsets (i.e., process and cross-process direction misregistrations) may be used in conjunction with double reflex printing offsets to adjust actuation times for the print heads to compensate for registration errors that may be introduced due to time varying changes in tension of the web as well as registration errors that may be introduced due to print head displacement that may occur over a period of time.

At procedure 395, the method 300 is configured to determine whether the determined process direction misregistration and cross-process direction misregistration are less than a threshold. In one embodiment, the threshold may be a predetermined value or range. If it is determined that the determined process direction misregistration and cross-process direction misregistration are less than the threshold, then the method 300 proceeds to procedure 398. If not (i.e., the determined process direction misregistration and cross-process direction misregistration are not less than the threshold), the method 300 returns to procedure 330 where the test pattern is printed on the template media (i.e., during cycle up), then to procedure 340 and so on. In one embodiment, if the determined process direction misregistration and cross-process direction misregistration are not less than the threshold, then the method 300 may be configured to adjust the cross-process position and process position of print heads before returning to procedure 330.

In one embodiment, if it is determined that the determined process direction misregistration and cross-process direction misregistration are less than the threshold, then the method 300 (i.e., before proceeding to procedure 410) is configured to adjust cross-process position and process position of print heads to provide accurate color registration on subsequent template media.

In one embodiment, the registration algorithm (i.e., procedures 390 and 395 as shown and explained with respect to FIG. 3A) uses the amplitude of a repeating pattern at the expected spacing between dashes to compute the x- and the y-positions.

The method 300 ends at procedure 398, where cycle up of the continuous web printer system 100 ends and printing (i.e., runtime print job) starts.

In one embodiment, the procedures 310-398 can be performed by one or more computer program modules that can be executed by one or more processors 220 (as shown in and explained with respect to FIGS. 1 and 2).

Figure 3B:
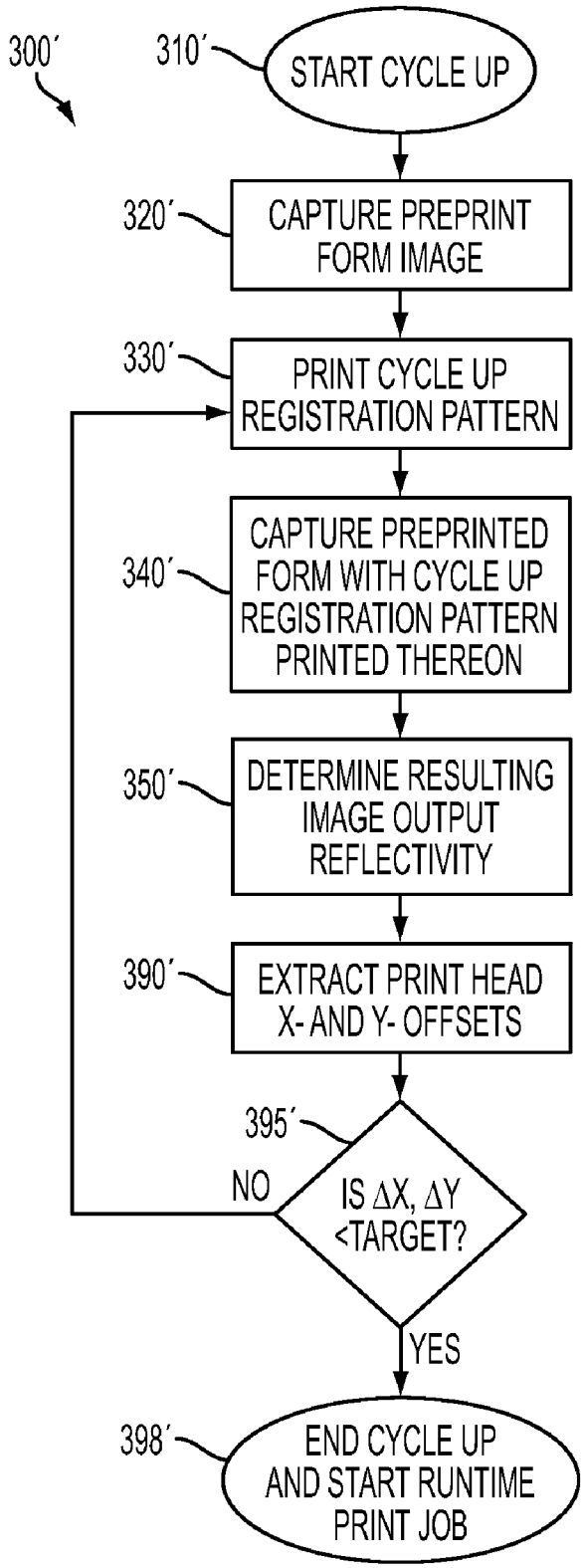
FIG. 3B illustrates a method for performing color registration on template media having template markings thereon in accordance with another embodiment of the present disclosure.

FIG. 3B provides the method 300' for performing color registration on template media having template markings thereon. The method 300' is a computer-implemented method that is implemented in a computer system comprising one or more processors 220 (as shown in and explained with respect to FIGS. 1 and 2) configured to execute one or more computer program modules.

The procedures 310'-340' of the method 300' are similar to the procedures of 310-340 of the method 300 (shown and described in detail with respect to FIG. 3A), and hence will not be explained in detail here. Also, the procedures 390', 395', and 398' of the method 300' are similar to the procedures 390, 395, and 398 of the method 300 (shown and described in detail with respect to FIG. 3A), and hence will not be explained in detail here.

In one embodiment, the method 300' may include an (optional) image enhancement procedure, where the method 300' is configured to provide digital image enhancement to the output data (i.e., image data of the test pattern). This image enhancement may include improving image contrast by reducing additional noise. In one embodiment, this optional image enhancement procedure may be performed after obtaining the output data (i.e., representative of image data of the test pattern) at procedure 350'.

As noted above, the method or mode 300' is similar to the method or mode 300 (as described and show in detail with respect to FIG. 3A), except for the differences as will be noted below.

After obtaining the second image data at procedure 340', the method or mode 300' proceeds to procedure 350'. At procedure 350', the processor 220 is configured to (a) transform the first image data and the second image data into a reflectivity space to obtain a first reflectivity and a second reflectivity, respectively; (b) determine a ratio of the second reflectivity and the first reflectivity to obtain an output reflectivity; and (c) obtain an output image data from the output reflectivity. The output image data is representative of the image data of the test pattern.

Specifically, at procedure 350', the method 300' is configured to transform the first image data and the second image data into reflectivity space to obtain a first reflectivity and a second reflectivity, respectively.

The first image data (shown in FIGS. 8A and 8B) consists of a two-dimensional array of sensor response values. Similarly, the second image data (shown in FIGS. 9A and 9B) consists of a two-dimensional array of sensor response values.

The first image data is transformed into reflectivity space by dividing the first image data (i.e., linear array sensor response profile of the template media with template markings thereon) by 255 (i.e., eight-bit grayscale space), according to the Equation (7):

$$(ppf(x,y)/255)=R_{ppf}(x,y) \qquad \text{Equation (7)}$$

where ppf(x,y) (pre-printed-form) is the first image data as sensed by the sensor at location (x,y);

255 is eight-bit grayscale space; and $R_{ppf}(x,y)$ is the first image data in reflectivity space or the first reflectivity.

It is noted that the first image data in reflectivity space or the first reflectivity may also be expressed in absorbance space using the Equation (8):

$$R_{ppf}(x,y)=10^{-a_{ppf}(x,y)} \qquad \text{Equation (8)}$$

where $R_{ppf}(x, y)$ is the first image data in reflectivity space or the first reflectivity; and $a_{ppf}(x, y)$ is the first image data in absorbance space (or the first absorbance used in method or mode 300 shown in FIG. 3A).

In other words, ppf(x, y) is the first image data as sensed by the sensor at location (x, y), while $R_{ppf}(x, y)$ and $a_{ppf}(x, y)$ are corresponding reflectivity and corresponding absorbance at that location.

The second image data is transformed into reflectivity space by dividing the second image data (i.e., linear array sensor response profile of the template media along with the test pattern printed thereon) by 255 (i.e., eight-bit grayscale space), according to the Equation (9):

$$(ppf_rt(x,y)/255)=R_{ppf_rt}(x,y) \qquad \text{Equation (9)}$$

where ppf_rt(x, y) (pre-printed-form-registration-target) is the second image data;

255 is eight-bit grayscale space; and $R_{ppf_rt}(x, y)$ is the second image data in reflectivity space or the second reflectivity.

It is noted that the second image data in reflectivity space or the second reflectivity may also be expressed in absorbance space using the Equation (10):

$$R_{ppf_rt}(x, y) = 10^{-a_{ppf_rt}(x,y)} \qquad \text{Equation (10)}$$

where $R_{ppf_rt}(x, y)$ is the second image data in reflectivity space or the second reflectivity; and $a_{ppf_rt}(x, y)$ is the second image data in absorbance space (or the second absorbance used in method or mode 300 shown in FIG. 3A).

In other words, ppf_rt(x, y) is the second image data as sensed by the sensor at location (x, y), while $R_{ppf_rt}(x, y)$ and $a_{ppf_rt}(x, y)$ are corresponding reflectivity and corresponding absorbance at that location.

In one embodiment, ppf(x, y) and ppf_rt(x, y) are numbers that lie within the range of 0-255. Therefore, the first image data that is obtained from Equation (7) is a number that lies within the range of 0-1. Similarly, the second image data obtained from Equation (9) is a number that lies within the range of 0-1.

Using the Equations (7) and (9), a mathematical expression for output reflectivity may be obtained. The output reflectivity is representative of the reflectivity corresponding to the test pattern. The output reflectivity is expressed as a ratio of the second reflectivity $R_{ppf_rt}(x, y)$ to the first reflectivity $R_{ppf}(x, y)$. The output reflectivity, $R_r(x, y)_t$, is determined according to the Equation (11):

$$R_{rt}(x, y) = \frac{R_{ppf_rt}(x, y)}{R_{ppf}(x, y)} \quad \text{Equation (11)}$$

where $R_{rt}(x, y)$ is the output reflectivity;

$R_{ppf_rt}(x, y)$ is the second reflectivity; and $R_{ppf}(x, y)$ is the first reflectivity.

Obviously, from computational proficiency, by using Equations (7) and (9), the output reflectivity is obtained by the ration of the second image data to the first image data. It is noted that the subtraction of absorbances (discussed in the method or mode 300 in FIG. 3A) may be expressed as a ratio of the second reflectivity $R_{ppf_rt}(x, y)$ to the first reflectivity $R_{ppf}(x, y)$ to obtain the output reflectivity as shown in Equation (12).

$$R_{rt}(x, y) = 10^{-a_{rt}(x,y)} = 10^{-(a_{ppf_rt}(x,y) - a_{ppf}(x,y))} = \frac{10^{-a_{ppf_rt}(x,y)}}{10^{-a_{ppf}(x,y)}} = \frac{R_{ppf_rt}(x, y)}{R_{ppf}(x, y)} \quad \text{Equation 12}$$

where $R_{rt}(x, y)$ is the output reflectivity;

$R_{ppf_rt}(x, y)$ is the second reflectivity;

$R_{ppf}(x, y)$ is the first reflectivity;

$a_{rt}(x, y)$ is the output absorbance;

$a_{ppf_rt}(x, y)$ is the second absorbance; and $a_{ppf}(x, y)$ is the first absorbance.

Figure 4:
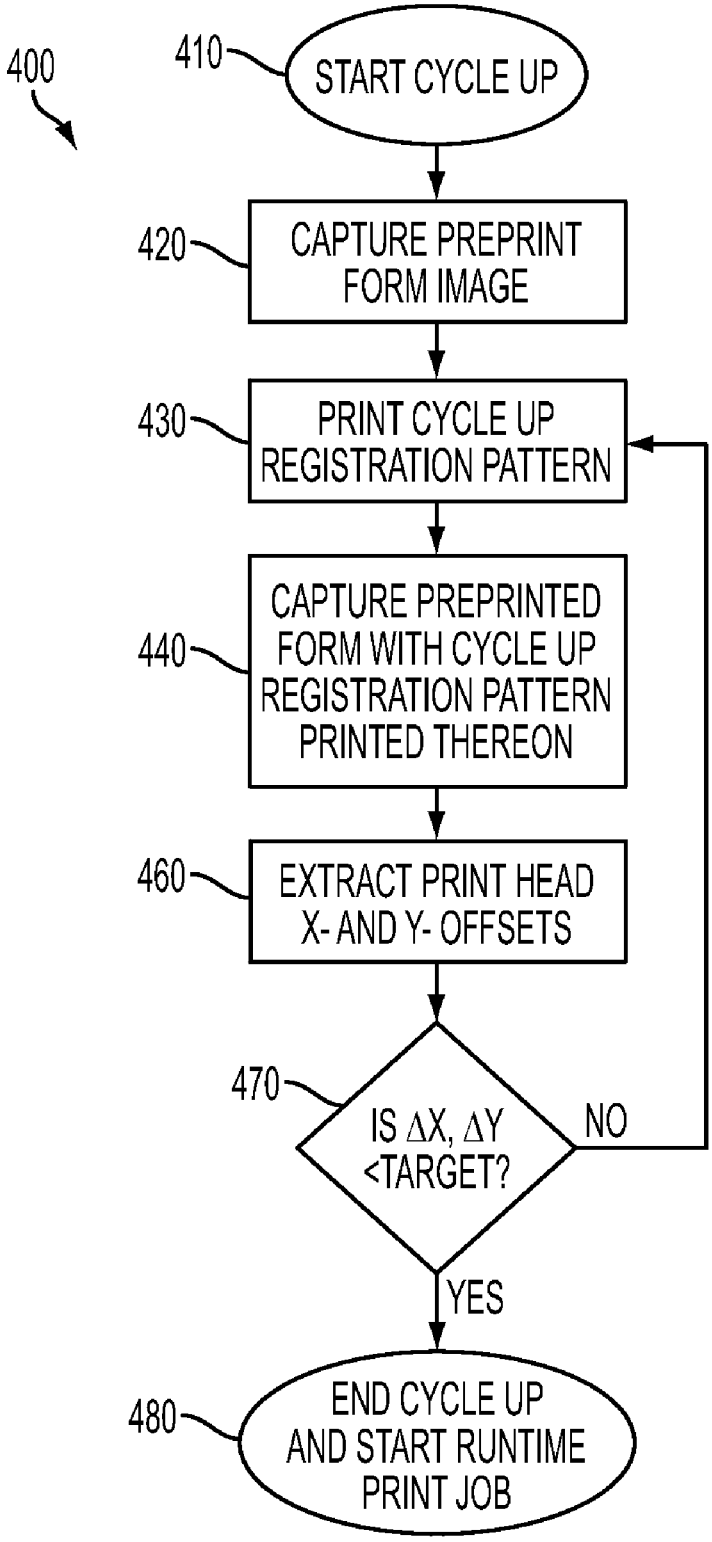
FIG. 4 illustrates a method for performing color registration on template media having template markings thereon in accordance with another embodiment of the present disclosure.

FIG. 4 shows a method 400 for performing color registration on template media having template markings thereon in accordance with another embodiment of the present disclosure.

The method 400 is configured to simply capture the printed test pattern on the template media (procedures 310-340 in FIG. 3A) and executing the registration algorithm (procedures 390-398 in FIG. 3A). The method 400 is useful in cases having low pre-printed/template media image content. That is, the method 400 may be used for template media having low density or low area coverage pre-printed forms. In other words, the method 400 is useful in cases where the noise added to the test pattern is relatively low. For example, the method 400, when used in such cases (i.e., low pre-printed/template media image content and the noise added to the test pattern is relatively low), provides some advantages like development and operational costs (i.e., it uses the same algorithm, procedure, paper amount, etc. than that of blank paper) and productivity.

The procedures 410-440 of the method 400 are similar to the procedures of 310-340 of the method 300 (shown and described in detail with respect to FIG. 3A), and hence will not be explained in detail here. Also, the procedures 460, 470 and 480 of the method 400 are similar to the procedures 390, 395, and 398 of the method 300 (shown and described in detail with respect to FIG. 3A), and hence will not be explained in detail here.

In one embodiment, the method 400 may include an (optional) image enhancement procedure, where the method 400 is configured to provide digital image enhancement to the second image data. This image enhancement may include improving image contrast by reducing additional noise. In one embodiment, this optional image enhancement procedure may be performed after obtaining the second image data (i.e., representative of image data of the test pattern printed on the template media) at procedure 440.

Figure 5:
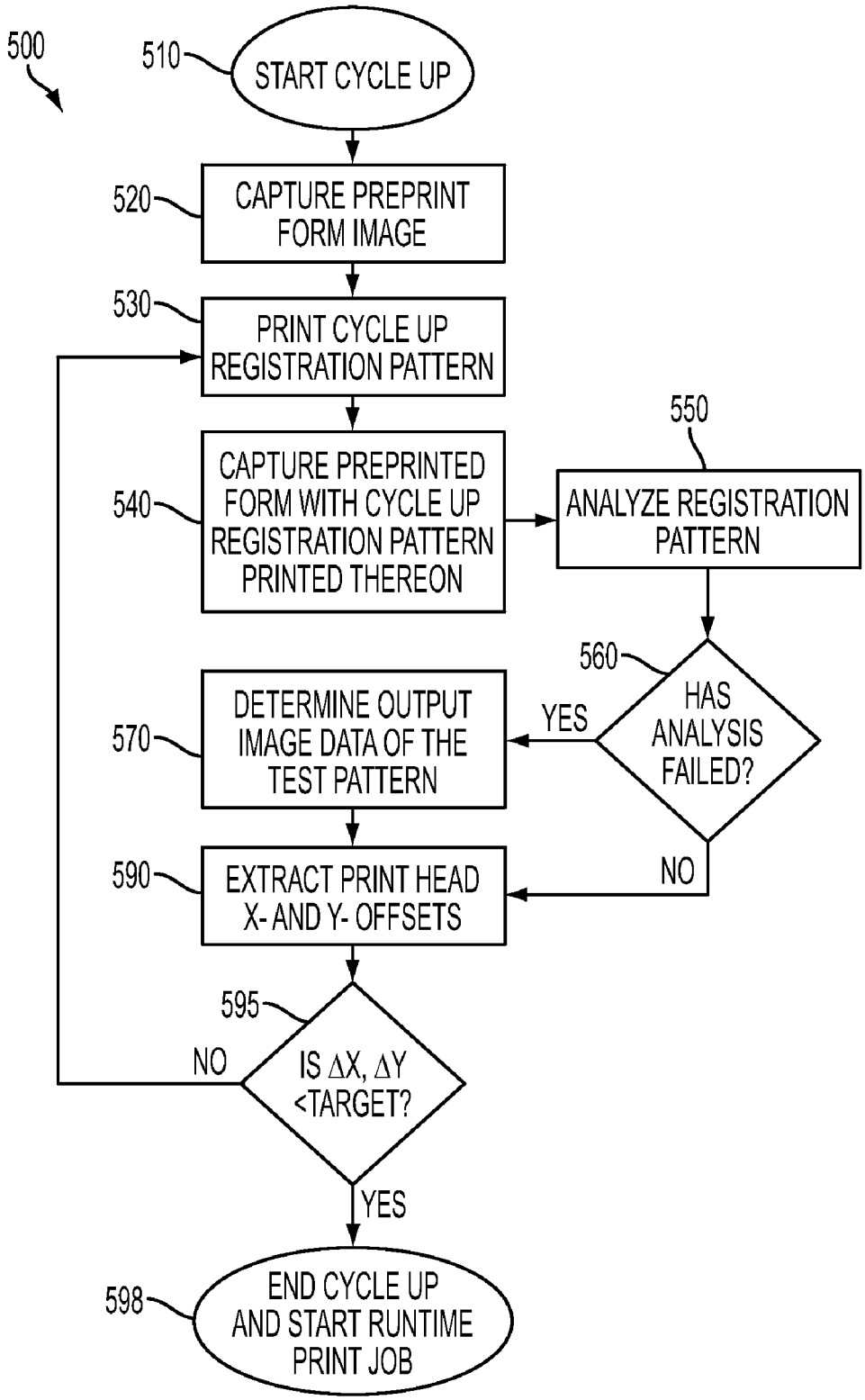
FIG. 5 illustrates a method for performing color registration on template media having template markings thereon in accordance with another embodiment of the present disclosure.

FIG. 5 provides the method 500 for performing color registration on template media having template markings thereon. The method 500 is a computer-implemented method that is implemented in a computer system comprising one or more processors 220 (as shown in and explained with respect to FIGS. 1 and 2) configured to execute one or more computer program modules.

The procedures 510-540 of the method 500 are similar to the procedures of 310-340 of the method 300 (shown and described in detail with respect to FIG. 3A), and hence will not be explained in detail here. Also, the procedures 590, 595, and 598 of the method 500 are similar to the procedures 390, 395, and 398 of the method 300 (shown and described in detail with respect to FIG. 3A), and hence will not be explained in detail here.

In one embodiment, the method 500 may include an (optional) image enhancement procedure, where the method 500 is configured to provide digital image enhancement to the output data (i.e., image data of the test pattern). This image enhancement may include improving image contrast by reducing additional noise. In one embodiment, this optional image enhancement procedure may be performed after obtaining the output data (i.e., representative of image data of the test pattern) at procedure 570. In one embodiment, this optional image enhancement procedure may be performed after procedure 560 (i.e., but before procedure 590).

After the second image data is obtained (i.e., at procedure 540), the method 500 proceeds to procedure 550. At procedure 550, the method 500 is configured to analyze the second image data to obtain image data of the test pattern (i.e., used to extract print head x-offset and y-offset). The analysis performed at procedure 550 is useful in cases where the template media includes low pre-printed/template media image content, or low density or low area coverage pre-printed forms. In other words, the analysis performed at procedure 550 is useful in cases where the noise (i.e., from the pre-printed form) added to the test pattern is relatively low.

At procedure 560, the method 500 is configured to determine whether the analysis performed has failed. If it is determined that the analysis performed has not failed (i.e., the analysis provides image data of the test pattern that is used to extract print head x-offset and y-offset), then the method 500 proceeds to procedure 590 where the image data of the test pattern is used to extract x-offset and y-offset of the print head. In other words, in cases, for example, where the template media includes low pre-printed/template media image content, or low density or low area coverage pre-printed forms, the analysis performed at procedure 550 does not fail.

If not (i.e., analysis performed has failed), the method 500 proceeds to procedure 570 where the second image data and the first image data are further analyzed to determine the output image data of the test pattern. The analysis performed at procedure 550 fails in cases, for example, where the template media includes high pre-printed/template media image content. At procedure 570, the output image data of the test pattern may be determined either by using a) procedures 350-370 as described in the method 300 or b) procedure 350' as described in the method 300'. After the output image data of the test pattern is determined at procedure 570, the method 500 the proceeds procedure 590 where the image data of the test pattern is used to extract x-offset and y-offset of the print head. Therefore, the method 500 combines both methods 300 (or 300') and 400. The method 500 includes an automatic criterion that is used to decide between high pre-printed content and low pre-printed content.

For method 300, the image processing procedure consists of converting image data (as shown in FIGS. 8A and 8B, and 9A and 9B) to absorbances in the absorbance space (i.e., using Equations 3 and 4 at procedure 350 in FIG. 3A), subtracting the absorbances (i.e., Equation 5 at procedure 360 in FIG. 3A), then convert back the absorbance to reflectivity space (i.e., Equation 6 at procedure 370 in FIG. 3A). Thereafter the registration algorithm (i.e., procedures 390-398 in FIG. 3A) is applied. For method 300', the image processing procedure consists of obtaining the output reflectivity by taking a ratio of the second reflectivity (or the second image data) and the first reflectivity (or the first image data). Thereafter the registration algorithm (i.e., procedures 390-398 in FIG. 3A) is applied. For method 400, captured image of FIGS. 8A and 8B is directly processed using the image processing and registration algorithm (i.e., procedures 450-480 in FIG. 4).

The methods 300, 300', and 400 described in present disclosure are in-situ methods to achieve x- and y-registration in continuous feed direct marking printing system when using pre-printed forms. This method is effective against a variety of preprinted forms, because the registration algorithm has low sensitivity to the optical density of the dashes in the test patterns. The methods 300, 300', and 400 deal with the added preprinted image noise. For example, in the case of the method 300 or 300', the noise is dramatically reduced, but still larger than that of standard blank paper. For the method 400, the pre-printed form adds noises and degrades the signal, e.g., black text (of the pre-printed form) in yellow (i.e., dashes in the test pattern) adds too much noise to enable registration. As explained earlier, the image contrast may be improved in method 400 to perform color registration.

As used herein, "template markings" are any type of marks, visible to the human eye or otherwise detectable by some kind of sensor, that are positioned on the web so that marks or images subsequently made on the web in a printing process in some way fit with or correspond to the template markings, either whereby the template markings and the printed images form a single coherent visible image, or for some other purpose, such as fiducial or encoding marks. As a non-limiting example, a template markings may also be in the form a physical feature of the web, such as perforations, notches, or stickers disposed on a backing web, in cases where an image printing system is used to make labels.

Embodiments of the present disclosure, the processor, for example, may be made in hardware, firmware, software, or various combinations thereof The present disclosure may also be implemented as instructions stored on a machine-readable medium, which may be read and executed using one or more processors. In one embodiment, the machine-readable medium may include various mechanisms for storing and/or transmitting information in a form that may be read by a machine (e.g., a computing device). For example, a machine-readable storage medium may include read only memory, random access memory, magnetic disk storage media, optical storage media, flash memory devices, and other media for storing information, and a machine-readable transmission media may include forms of propagated signals, including carrier waves, infrared signals, digital signals, and other media for transmitting information. While firmware, software, routines, or instructions may be described in the above disclosure in terms of specific exemplary aspects and embodiments performing certain actions, it will be apparent that such descriptions are merely for the sake of convenience and that such actions in fact result from computing devices, processing devices, processors, controllers, or other devices or machines executing the firmware, software, routines, or instructions.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A computer-implemented method for performing color registration on template media having template markings thereon, wherein the method is implemented in a computer system comprising one or more processors configured to execute one or more computer program modules, the method comprising:

sensing the template media using a linear array sensor positioned along a process path of a web to obtain first image data;

printing a test pattern on the template media;

sensing the template media along with the test pattern printed thereon using the linear array sensor to obtain second image data;

transforming the first image data and the second image data into an absorbance space to obtain a first absorbance and a second absorbance, respectively;

determining a difference between the first absorbance and the second absorbance to obtain an output absorbance, the output absorbance being representative of absorbance corresponding to the test pattern;

transforming the output absorbance into a reflectivity space to obtain an output data, the output data being representative of image data of the test pattern;

determining a process direction misregistration and a cross-process direction misregistration from the output data; and adjusting a cross-process position and a process position of print heads based on the process direction misregistration and cross-process direction misregistration to provide accurate color registration on subsequent template media.

2. The method of claim 1, wherein the template media is in the form of a continuous web having a plurality of template media.

3. The method of claim 2, wherein sensing the template media using the linear array sensor to obtain the first image data comprises sensing a first template media of the continuous web.

4. The method of claim 3, wherein printing the test pattern on the template media comprises printing the test pattern on a second or subsequent template media.

5. The method of claim 4, wherein sensing the template media along with the test pattern printed thereon using the linear array sensor to obtain the second image data comprises sensing the second or subsequent template media of the continuous web.

6. The method of claim 1, wherein the first image data is a linear array sensor response profile of the template media.

7. The method of claim 6, wherein the first absorbance is obtained by talking a decimal logarithm for the first image data, according to the equation:

$$a_ppf=-\log_{10}(ppf/255)$$

where a_ppf is the first absorbance;
ppf is the first image data; and
255 is eight-bit grayscale space.

8. The method of claim 7, wherein the second image data is a linear array sensor response profile of the template media along with the test pattern printed thereon.

9. The method of claim 8, wherein the second absorbance is obtained by talking a decimal logarithm for the second image data, according to the equation:

$$a_ppf_rt=-\log_{10}(ppf_rt/255)$$

where a_ppf_rt is the second absorbance;
ppf_rt is the second image data; and
255 is eight-bit grayscale space.

10. The method of claim 9, wherein the output data is obtained by taking an exponential function of the output absorbance, according to the equation:

$$r_rt=10^{-a_rt}$$

Where r_rt is the output data; and
a_rt is the output absorbance.

11. The method of claim 1, wherein the template markings include form images, marks, report formats, banners, logos, letterhead, data heading for spaces for data, pre-printed printed text, pre-printed boxes, pre-printed lines, and/or questions with corresponding spaces for answers.

12. The method of claim 1, wherein the print heads comprises at least two print heads being axially spaced apart from each other in a process direction of the process path of the web.

13. The method of claim 1, wherein the print heads comprises at least two print heads being at the same position and spaced from each other in a cross-process direction of the process path of the web.

14. The method of claim 1, wherein the linear array sensor is a full width array (FWA) sensor.

15. The method of claim 1, wherein the test pattern comprises a plurality of dashes, the dashes being process direction dashes.

16. The method of claim 9, further comprising improving the contrast of the output data.

17. A system for performing color registration on template media having template markings thereon, the system comprising:

a print engine configured to print a test pattern on the template media;

a linear array sensor positioned along a process path of a web, the linear array sensor configured to sense a) the template media to obtain first image data; and b) the template media along with the test pattern printed thereon to obtain second image data;

a processor configured to:

a) transform the first image data and the second image data into an absorbance space to obtain a first absorbance and a second absorbance, respectively;

b) determine an output absorbance by calculating a difference between the first absorbance and the second absorbance, the output absorbance being representative of absorbance corresponding to the test pattern;

c) transform the output absorbance into a reflectivity space to obtain an output data, the output data being representative of image data of the test pattern; and d) determine a process direction misregistration and a cross-process direction misregistration from the output data; and a controller configured to adjust a cross-process position and a process position of print heads based on the process direction misregistration and cross-process direction misregistration to provide accurate color registration on subsequent template media.

18. The system of claim 17, wherein the template media is in the form of a continuous web having a plurality of template media.

19. The system of claim 18, wherein the linear array sensor is configured to sense a first template media of the continuous web to obtain the first image data.

20. The system of claim 19, wherein the print engine is configured to print the test pattern on a second or subsequent media of the continuous web.

21. The system of claim 20, wherein the linear array sensor is configured to sense the second or subsequent template media of the continuous web to obtain the second image data, the second or subsequent template media includes the template media along with the test pattern printed thereon.

22. The system of claim 17, wherein the first image data is a linear array sensor response profile of the template media.

23. The system of claim 22, wherein the first absorbance is obtained by taking a decimal logarithm for the first image data, according to the equation:

$$a_ppf=-\log_{10}(ppf/255)$$

where a_ppf is the first absorbance;
ppf is the first image data; and
255 is eight-bit grayscale space.

24. The system of claim 23, wherein the second image data is a linear array sensor response profile of the template media along with the test pattern printed thereon.

25. The system of claim 24, wherein the second absorbance is obtained by taking a decimal logarithm for the second image data, according to the equation:

$$a_ppf_rt=-\log_{10}(ppf_rt/255)$$

where a_ppf_rt is the second absorbance;
ppf_rt is the second image data; and
255 is eight-bit grayscale space.

26. The system of claim 25, wherein the output data is obtained by taking an exponential function of the output absorbance, according to the equation:

$$r_rt=10^{-a_rt}$$

Where r_rt is the output data; and
a_rt is the output absorbance.

27. The system of claim 17, wherein the template markings include form images, marks, report formats, banners, logos, letterhead, data heading for spaces for data, pre-printed text, pre-printed boxes, pre-printed lines, and/or questions with corresponding spaces for answers.

28. The system of claim 17, wherein the print heads comprises at least two print heads being axially spaced apart from each other in a process direction of the process path of the web.

29. The system of claim 17, wherein the print heads comprises at least two print heads being at the same position and spaced from each other in a cross-process direction of the process path of the web.

30. The system of claim 17, wherein the linear array sensor is a full width array (FWA) sensor.

31. The system of claim 17, wherein the test pattern comprises a plurality of dashes, the dashes being process direction dashes.

32. A computer-implemented method for performing color registration on template media having template markings thereon, wherein the method is implemented in a computer system comprising one or more processors configured to execute one or more computer program modules, the method comprising:

sensing the template media using a linear array sensor positioned along a process path of a web to obtain first image data;

printing a test pattern on the template media;

sensing the template media along with the test pattern printed thereon using the linear array sensor to obtain second image data;

analyzing the second image data to obtain an output image data;

determining a process direction misregistration and a cross-process direction misregistration from the output image data; and adjusting a cross-process position and a process position of print heads based on the process direction misregistration and cross-process direction misregistration to provide accurate color registration on subsequent template media.

33. A computer-implemented method for performing color registration on template media having template markings thereon, wherein the method is implemented in a computer system comprising one or more processors configured to execute one or more computer program modules, the method comprising:

sensing the template media using a linear array sensor positioned along a process path of a web to obtain first image data;

printing a test pattern on the template media;

sensing the template media along with the test pattern printed thereon using the linear array sensor to obtain second image data;

analyzing the second image data to obtain an output image data, the output image data being representative of image data of the test pattern;

analyzing both the first image data and the second image data to obtain the output image data, if the analysis of the second image data fails to obtain the output image data;

determining a process direction misregistration and a cross-process direction misregistration from the output image data; and adjusting a cross-process position and a process position of print heads based on the process direction misregistration and cross-process direction misregistration to provide accurate color registration on subsequent template media.

34. The method of claim 33, wherein analyzing both the first image data and the second image data to obtain the output image data further includes:

(a) transforming the first image data and the second image data into a reflectivity space to obtain a first reflectivity and a second reflectivity, respectively;

(b) determining a ratio of the second reflectivity and the first reflectivity to obtain an output reflectivity, the output reflectivity being representative of reflectivity corresponding to the test pattern; and (c) obtaining the output image data from the output reflectivity.

35. The method of claim 33, wherein analyzing both the first image data and the second image data to obtain the output data further includes:

(a) transforming the first image data and the second image data into an absorbance space to obtain a first absorbance and a second absorbance, respectively;

(b) determining a difference between the first absorbance and the second absorbance to obtain an output absorbance, the output absorbance being representative of absorbance corresponding to the test pattern; and (c) transforming the output absorbance into a reflectivity space to obtain the output image data.

* * * * *